United States Patent [19]

Kline

[11] Patent Number: 4,565,460

[45] Date of Patent: Jan. 21, 1986

[54] CONVEX KEY TOP CONFIGURATIONS

[76] Inventor: Alva C. Kline, 35 Hewes St., Brentwood, N.Y. 11717

[21] Appl. No.: 586,427

[22] Filed: Mar. 5, 1984

[51] Int. Cl.[4] ..... B41J 5/12

[52] U.S. Cl. ..... 400/490; 400/491.3

[58] Field of Search ..... 400/122, 388.1, 472, 400/473, 474, 475, 476, 477, 478, 479, 479.1, 479.2, 480, 481, 482, 483, 484, 485, 486, 487, 488, 489, 490, 491, 491.1, 491.2, 491.3, 492, 493, 493.1, 493.2, 494, 495, 495.1, 496

[56] References Cited

U.S. PATENT DOCUMENTS

| | | | |
|---|---|---|---|
| 604,770 | 5/1898 | Lieb | 400/491.1 X |
| 626,915 | 6/1899 | Little | 400/486 X |
| 725,855 | 4/1903 | Loyd | 400/388.1 |
| 726,107 | 4/1903 | Stanton | 400/490 |
| 759,807 | 5/1904 | Brooks | 400/481 X |
| 1,041,696 | 10/1912 | Summerville | 400/494 |
| 1,414,229 | 4/1922 | Steinkraus | 400/122 |
| 1,781,071 | 11/1930 | Moyle | 400/491.1 |
| 2,181,955 | 12/1939 | Ward, Jr. | 400/491 |
| 2,266,432 | 12/1941 | Morin et al. | 400/490 X |
| 2,285,963 | 6/1942 | Gits et al. | 400/490 X |
| 2,886,158 | 5/1959 | Fess et al. | 400/481 |
| 3,387,693 | 6/1968 | Wirth | 400/491.3 |
| 3,396,827 | 8/1968 | Harwell | 400/491.3 |
| 3,871,506 | 3/1975 | Von Luders | 400/495 |
| 4,039,068 | 8/1977 | Giorza et al. | 400/493 X |

FOREIGN PATENT DOCUMENTS

| | | | |
|---|---|---|---|
| 586252 | 10/1933 | Fed. Rep. of Germany | 400/484 |
| 635576 | 9/1936 | Fed. Rep. of Germany | 400/493 |
| 3852 | 3/1905 | France | 400/486 |
| 1016055 | 10/1952 | France | 400/494 |
| 0885074 | 11/1981 | U.S.S.R. | 400/488 |

OTHER PUBLICATIONS

IBM Technical Disclosure Bulletin, "Braille Display Portable Electronic Calculator", Heath, vol. 23, No. 4, Sep. 1980, pp. 1727–1731.

*Primary Examiner*—Ernest T. Wright, Jr.
*Attorney, Agent, or Firm*—Erwin S. Teltscher

[57] ABSTRACT

A keyface for increasing the speed and accuracy of an operator of any key-operated or touch-operated system is adapted to be attached in a keystem of a keyboard. The keyboard is equipped with a plurality of keystems arranged in a predetermined order, and each keystem has a contoured surface area which normally faces upwardly. The keyface is made up of a element which has an operative upper convex surface of a prearranged surface area, and an operative lower surface adapted to be attached to the contoured surface area of the keystem. The lower surface area defines an area substantially matching at least a portion of the contoured surface area of the keystem. The element is dimensioned so as to be free from interfering with a similar element attached to a neighboring keystem of the keyboard.

7 Claims, 24 Drawing Figures

CONVEX KEY TOP CONFIGURATIONS

BACKGROUND OF THE INVENTION

A recent article in the "Scientific American", (Feb. 1984, Timothy A. Salthouse, The Skill of Typing, pages 128–135), focuses on the psychological aspects of typing speed, but the author admits that a century of study has not produced a definitive answer, short of several hypotheses. The article does not discuss the contribution of the interface of the key, namely its upper surface, with the fingertips of an operator. The conventional shape of the upper surface of a key is either concave, or flat, or flat bordered by an upwardly extending rim.

SUMMARY OF THE INVENTION

It is the object of my invention to make a further contribution towards increasing the speed and accuracy of an operator of any key-operated or touch-operated device or system.

A feature which has not received the attention it deserves in context with the above-noted object is the precise shape of the upper surface of a key. While the prior art uses predominantly an upper surface which is concave, my research has shown that better results, as far as typing speed is concerned, are obtained if the upper surface is convex. I have found this to be due to the fact that a convex upper surface provides the operator with a mental image of a larger area of attack for each finger. This, in turn, permits, as I have found in my research, the larger muscle sequence of a finger to dominate over what I call "the fine tuning muscles", and therefore, as I have discovered, permits the operator to type with greater ease, at less tension, and therefore at greater speed, less fatigue, and consequently with greater accuracy and fewer errors, than in keyboards of the prior art.

This object is attained by a keyface adapted to be attached to a keystem of a keyboard. The keyboard is equipped with a plurality of keystems arranged in a predetermined order, and wherein each keystem has a contoured surface area which normally faces upwardly, and is provided with an element which has an operative upper surface which is convex and has a prearranged surface area, and an operative lower surface adapted to be attached to the contoured surface area, and which in turn defines an area substantially matching at least a portion of the contoured surface area. The element is dimensioned so as to be free from interfering with a similar element of a neighboring keystem of the keyboard.

BRIEF DESCRIPTION OF THE DRAWING

My invention will be better understood with the aid of the drawing, in which.

DESCRIPTION OF THE PREFERRED EMBODIMENTS

Figure 8A:
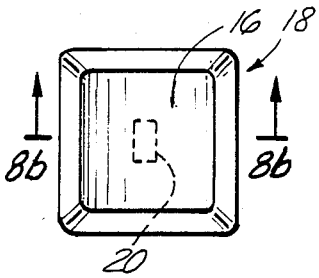
FIG. 8a PRIOR ART
FIG. 8*a* is a plan view of a keystem of the prior art, suitable for having an element, according to my invention, attached thereto.
Figure 8B:
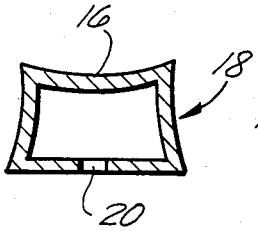
FIG. 8b PRIOR ART
FIG. 8*b* is a cross-section of the keystem shown in FIG. 8*a* along line 8*b*–8*b*.

Referring now to the drawing, the inventive keyface includes an element 10, which is formed with an operatively upper convex surface 12 extending over a prearranged surface area, and an operative lower surface area 14, which is adapted to be attached to a contoured surface area 16 of a conventional keystem 18. The keystem 18 is formed with a slot 20, as best seen in FIG. 8*a*, into which normally projects a (non-illustrated) projection of the keyboard, to hold the keystem 18 in place. The prearranged surface area of the convex surface 12 may range from about ½ $cm^2$ in the case of a calculator, to about 1.5 $cm^2$ in the case of a typewriter keyboard, or of a keyboard for a computer or the like. The lower surface area 14 may be either continuous, as illustrated, for example, in FIG. 4*b*, or discontinuous, as illustrated, for example, in FIG. 6*b*. If the contoured surface area 16 of a keystem 18 is concave, for example, the lower surface area 14 of a corresponding element 10 will be convex so as to substantially match at least a portion of the contoured surface area 16.

The lower surface area 14 may be about equal to, or larger than the area of the upper surface 12, for example in the case of a continous lower surface area 14, but may be smaller than the area of the upper surface 12 in the case of a discontinuous lower surface area 14.

Figure 7:
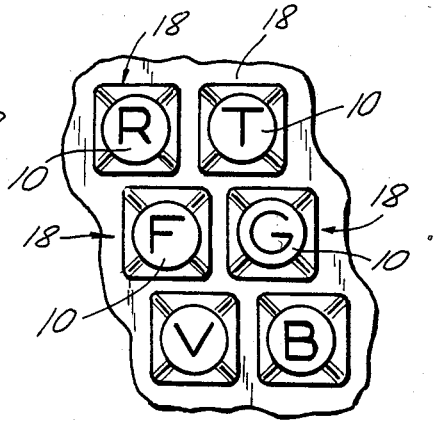
FIG. 7 is a plan view of a section of a keyboard incorporating my inventive elements.

It will be understood that as best seen, for example, in FIG. 7, the element 10 must always be so dimensioned so as to be free from interfering with a similar element 10 of a neighboring keystem 18 of the keyboard.

The convex upper surface 12 can assume a number of possible shapes; thus it can, for example, be hemispherical, form only a portion of a hemispherical surface, have a substantially parabolic shape, for example conform at least to a portion of a paraboloid, form part of an ellipsoid, and so on. The maximum height of the upper surface 12 above the lower surface 14 may be about 0.6 cm.

The upper convex surface 12 will always define a radius of curvature, which may, of course, be a smallest radius of curvature, for example, in the case of a surface portion of a paraboloid or of an ellipsoid. In a further development of the invention the upper convex surface 12 may be formed with a plurality of projections 22, for example, about 5 to 1000 of such projections may be formed on the upper convex surface 12. Each projection 22 extends at a height from the upper surface 12 which is substantially smaller than the smallest radius of curvature of the upper surface 12, for example to a height of about ½ mm.

Thus the upper surface 12 may, for example, constitute a so-called "pimpled" surface, so to speak, but will always have characteristics which are found comfortable to the user, so as to give the user a certain sense of roughness, without creating any sensation of discomfort or pain.

Figure 6A:
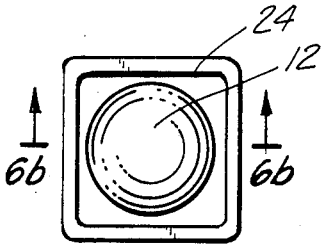
FIG. 6*a* is a plan view of still another version of my inventive element which includes a rim having a substantially square perimeter.
Figure 6B:
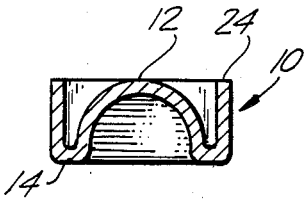
FIG. 6*b* is a cross-section along line 6*b*–6*b* of FIG. 6*a;*
Figure 6C:
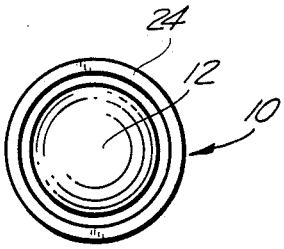
FIG. 6*c* is a plan view of an alternate version of my inventive element, along the concept of FIG. 6*a*, and having the same cross-section as FIG. 6*b;*

In a further development of the invention it may be desirable to provide the element 10 with an upwardly extending rim 24 as best seen, for example, in FIGS. 6*a* through 6*c*. The rim 24 may extend either below the upper surface 12, at a height just about equal thereto, or slightly thereabove, with a view, for example, to limit lateral movement of the operator's fingers only up to the rim 24.

As seen in plan view, the rim 24 may be circular, or assume substantially the form of a square perimeter.

Figure 4A:
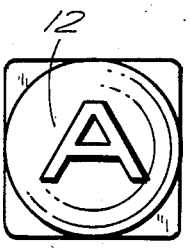
FIG. 4*a* is a plan view of a version of my inventive element, having an alpha-numeric character embossed thereon.
Figure 4B:
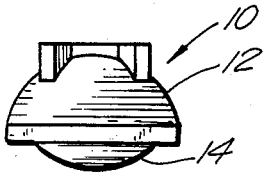
FIG. 4*b* is an elevation view corresponding to FIG. 4*a*, and having a lower surface contoured to match the upper surface of a corresponding keystem.
Figure 5A:
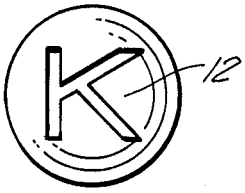
FIG. 5*a* is a plan view of another version of my inventive element, in which an alpha-numeric character is carved out therein in the form of a correspondingly shaped recess.
Figure 5B:
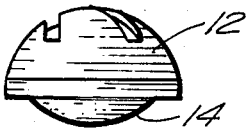
FIG. 5*b* is an elevation view corresponding to the version of FIG. 5*a*, and having a lower surface contoured to match the upper surface of a corresponding keystem.
Figure 5C:
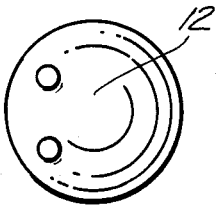
FIG. 5*c* is a plan view of still another version of my inventive element having embossed thereon a character in Braille.

In still another development of the invention, the upper surface 12 of the element 10 is embossed with an alpha-numeric character, and where the embossment is of a sufficient height to allow touch recognition by a blind person, as best seen, for example, in FIGS. 4*a*, 4*b*, and 5*c*, or is formed with a recess having the shape of an alpha-numeric character. The alpha-numeric character may be a letter, such as for example, shown in FIGS. 4*a*, 4*b*, and 5*a* and 5*b*, or a braille character, such as, for example, shown in FIG. 5*c*, or may be any other character.

Figure 1:
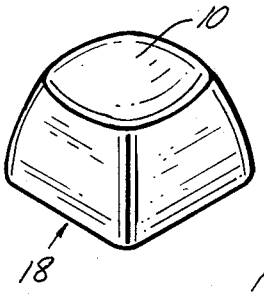
FIG. 1 is a perspective view of one version of the element, according to my invention, attached to, or integral with a keystem.
Figure 2A:
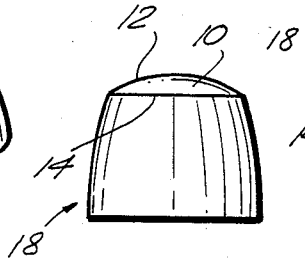
FIG. 2*a* is an elevation view of an embodiment, according to my invention, wherein the inventive element has a relatively low height above the keystem, and a top surface which is part of a paraboloid.
Figure 2B:
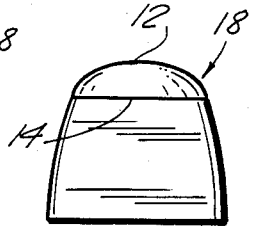
FIG. 2*b* is an elevation view of another embodiment, according to my invention, wherein the inventive element has a medium height above the keystem, and a top surface which is part of an ellipsoid.
Figure 2C:
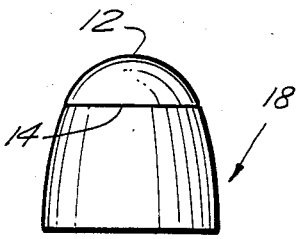
FIG. 2*c* is an elevation view of still another embodiment, according to my invention, wherein the inventive element has a considerable height above the keystem, and substantially approximates at least a portion of a hemisphere.
Figure 2D:
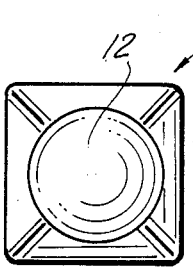
FIG. 2*d* is a plan view corresponding to either FIG. 2*a*, FIG. 2*b*, or FIG. 2*c*, using a keystem having a substantially square cross-section.
Figure 2E:
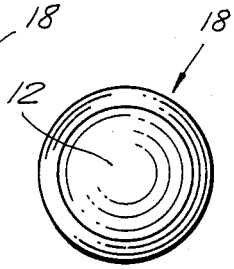
FIG. 2*e* is a plan view corresponding to either FIG. 2*a*, FIG. 2*b*, or FIG. 2*c*, but using a keystem having a substantially circular cross-section.
Figure 2F:
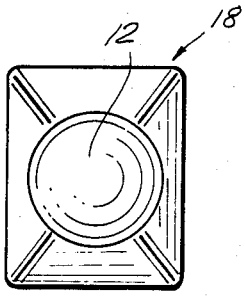
FIG. 2*f* is a plan view corresponding to either FIG. 2*a*, FIG. 2*b*, or FIG. 2*c*, but using a keystem having a substantially rectangular cross-section.
Figure 2G:
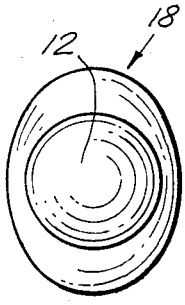
FIG. 2*g* is a plan view corresponding to either FIG. 2*a*, FIG. 2*b*, or FIG. 2*c*, but using a keystem having a substantially oval cross-section.
Figure 3A:
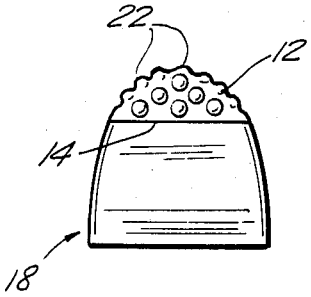
FIG. 3*a* is an elevation view of my inventive element attached to a keystem, and wherein the inventive element has an upper "pimpled" surface, or an upper surface studded with a plurality of projections.
Figure 3B:
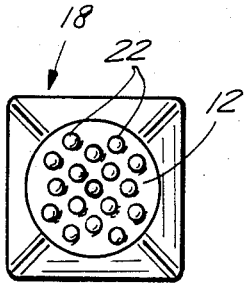
FIG. 3*b* is a plan view corresponding to FIG. 3*a*, using a keystem having a substantially square cross-section.
Figure 3C:
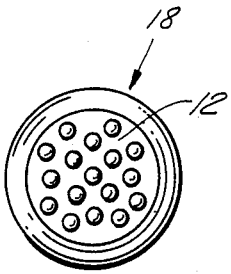
FIG. 3*c* is a plan view corresponding to FIG. 3*a*, but using a keystem having a substantially circular cross-section.

The perimeter of the upper surface 12 may, in a preferred version, be substantially circular, but may also have an oval, a rectangular, or a substantially square perimeter, as, for example, shown in FIG. 1, or may have any other suitable perimeter in between a circular perimeter and a square perimeter.

The element 10 may be made of metal, synthetic plastic, or of any other material suitable to provide a firm resistant surface of sufficient durability so as to have an operating life at least equal to that of the keyboard or machine of which it forms a part. It can be attached to a corresponding keystem 18 by any suitable adhesive, such as commercially available glue, taking into account the material of the keystem 18, on one hand, and that of the element 10, on the other hand.

The cross section of the keystem or as it is viewed in a top plan view in addition to being substantially square, oval or circular may also be triangular in a keyboard. The apex of a triangular stem pointing inwardly toward the operator, would alternate with an adjoining apex pointing outwardly away from the operator.

Figure 9:
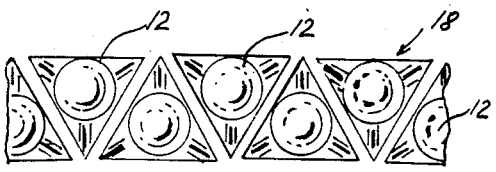
FIG. 9 is a top plan view of a keyboard having triangular keystems.
Figure 10:
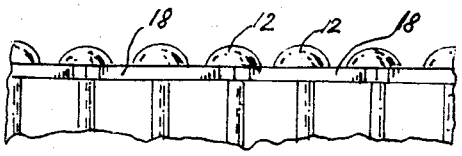
FIG. 10 is an elevation view of the key-board shown in FIG. 9.

A top plan view of a keyboard having triangular keystems 18 is shown in FIG. 9, while an elevation view of a keyboard having triangular keystems 18, where the apex of a triangular stem pointing inwardly toward the operator alternates with an adjoining apex pointing outwardly away from the operator is shown in FIG. 10.

In an alternate development of the invention, the element 10 may be an integral part of the keystem 18, so as to form a single one-piece key of conventional shape, for example, the keystem 18 shown in FIG. 1 having substantially a square base of about 3 $cm^2$ area, and a height of about 1.5 cm.

It is intended that the level or height of the upper surface 12 above the base of the keystem 18 be in either case substantially that of the surface it replaces. This means that the element 10 will either be relatively thin, or where this is not practical or feasible, the height of the keystem 18 will be correspondingly reduced to achieve the above-named object.

I wish it to be understood that I do not desire to be limited to the exact details of construction shown and described, for obvious modifications will occur to a person skilled in the art.

Having thus described the invention, what I claim as new, and desire to be secured by Letters Patent is as follows:

1. A keyface attachable to a keystem of a keyboard which includes a plurality of keystems arranged in a predetermined order, each keystem having a contoured surface area normally facing upwardly, comprising in combination an element which has an operative upper surface which is convex, has a substantially predetermined smallest radius of curvature, has a prearranged pimpled surface area which is formed with a plurality of projections in the range of about 500 to about 1000, each projection extending at a height from said uper surface which is substantially smaller than said smallest radius, and an operative lower surface attachable to said contoured surface area, and defining an area substantially matching at least a portion of said contoured surface area, said element being dimensioned so as to be free from interfering with a similar element of a neighbouring keystem of said keyboard.

2. A keyboard comprising in combination a plurality of keystems arranged in a predetermined order, wherein each keystem has a contoured surface area normally facing upwardly, and a plurality of elements, each element having an operative upper surface which is convex, and defining a prearranged surface area, and an operative lower surface area, said lower surface area of each element being attachable to the contoured surface area of a corresponding keystem, each element being dimensioned so as to be free from interfering with a similar element of a neighboring keystem of said keyboard, each keystem, as viewed in a top plan view, having a substantially triangular cross-section, and wherein an apex of one triangular keystem pointing inwardly towards an operator alternates with the apex of an adjoining triangular keystem pointing outwardly away from the operator.

3. A keyface as claimed in claim 2, wherein said operative upper surface is substantially hemispherical.

4. A keyface as claimed in claim 2, wherein said operative upper surface conforms substantially to at least a portion of a hemispherical surface.

5. A keyface as claimed in claim 2, wherein said operative upper surface conforms to a portion of a paraboloid.

6. A keyface as claimed in claim 2, wherein said operative upper surface conforms to a portion of an ellipsoid.

7. A keyface as claimed in claim 2, wherein each of said elements further includes an upwardly extending rim.

* * * * *

UNITED STATES PATENT AND TRADEMARK OFFICE

CERTIFICATE OF CORRECTION

PATENT NO. : 4,565,460

DATED : Jan. 21, 1986

INVENTOR(S) : Klein

It is certified that error appears in the above-identified patent and that said Letters Patent is hereby corrected as shown below:

Title page, Item [19] should read --Klein--

Inventors: Item [76] should read --Alva C. Klein--

Signed and Sealed this

*Eighth* Day of *April 1986*

[SEAL]

*Attest:*

DONALD J. QUIGG

*Attesting Officer*

*Commissioner of Patents and Trademarks*